US008006724B2

(12) United States Patent
Hartono et al.

(10) Patent No.: US 8,006,724 B2
(45) Date of Patent: Aug. 30, 2011

(54) APPARATUS FOR TRANSFERRING A CRYOGENIC FLUID

(75) Inventors: John S. Hartono, Oakland, CA (US); Kenneth W. Sheets, Jr., San Ramon, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 1270 days.

(21) Appl. No.: 11/613,453

(22) Filed: Dec. 20, 2006

(65) Prior Publication Data

US 2008/0148740 A1 Jun. 26, 2008

(51) Int. Cl.
*F17C 3/10* (2006.01)

(52) U.S. Cl. ..... 141/82; 141/290; 141/302; 62/50.7; 138/114

(58) Field of Classification Search ..... 141/82, 141/98, 285, 290, 301, 302; 62/50.1, 50.7
See application file for complete search history.

(56) References Cited

U.S. PATENT DOCUMENTS

| | | | | |
|---|---|---|---|---|
| 4,315,408 | A | 2/1982 | Karl | |
| 4,445,543 | A | 5/1984 | Mead | |
| 4,826,354 | A * | 5/1989 | Adorjan | 405/158 |
| 4,887,433 | A * | 12/1989 | Locatelli | 62/50.7 |
| 5,307,639 | A * | 5/1994 | Boissin | 62/50.7 |
| 6,012,292 | A | 1/2000 | Gulati et al. | |
| 6,021,848 | A * | 2/2000 | Breivik et al. | 166/344 |
| 6,244,053 | B1 | 6/2001 | Gulati et al. | |
| 6,354,090 | B1 * | 3/2002 | Sengelin | 62/50.7 |
| 6,973,948 | B2 * | 12/2005 | Pollack et al. | 141/387 |
| 7,080,673 | B2 * | 7/2006 | Pollack et al. | 141/387 |
| 7,131,278 | B2 * | 11/2006 | Svensson et al. | 62/50.1 |
| 7,438,617 | B2 * | 10/2008 | Poldervaart et al. | 441/5 |
| 7,464,557 | B2 * | 12/2008 | Vandor et al. | 62/50.2 |
| 7,464,734 | B2 * | 12/2008 | Liu | 141/82 |
| 7,484,370 | B2 * | 2/2009 | Kwon et al. | 62/47.1 |
| 2007/0095427 | A1 * | 5/2007 | Ehrhardt et al. | 141/387 |
| 2009/0266087 | A1 * | 10/2009 | Adkins et al. | 62/50.7 |

FOREIGN PATENT DOCUMENTS

WO WO 2005/059432 * 6/2005

OTHER PUBLICATIONS

Case Study: Stress and thermal analysis of an LNG marine loading arm, http:/www.lusas.com/case/analyst/loadingarm.html, Dec. 13, 2006, pp. 1-3.

Chiksan Marine Loading Arms, http://www.fmctechnologies.com/LoadingSystems/Solutions/TopsidesPackages/ChicksanMarineLoadingArms.aspx, Dec. 13, 2006, pp. 1-2.

* cited by examiner

*Primary Examiner* — Gregory L. Huson
*Assistant Examiner* — Nicolas A Arnett
(74) *Attorney, Agent, or Firm* — Frank Turner; Karen DiDomenicis; Richard Schulte

(57) ABSTRACT

An apparatus for transferring a cryogenic fluid. The apparatus includes a conduit having an inlet and an outlet, a source of cryogenic fluid connected to the inlet for providing cryogenic fluid to the conduit and a cool down line connected to the conduit at an intermediate port between the inlet and the outlet, the cool down line in fluid communication with the source of cryogenic fluid for providing cryogenic fluid to the conduit through the intermediate port. The cool down line can be external and intersect with the conduit at the intermediate port, or may be disposed within the conduit. The conduit may have more than one intermediate port for providing cryogenic fluid to the conduit downstream from the inlet. Such an apparatus enables a conduit for transferring a cryogenic fluid to be pre-cooled to a cryogenic temperature more quickly so that transfer operations can begin.

2 Claims, 4 Drawing Sheets

APPARATUS FOR TRANSFERRING A CRYOGENIC FLUID

FIELD OF THE INVENTION

The present invention relates to the transfer of cryogenic fluids, such as a liquefied natural gas, to or from a floating vessel, prior to or following transport from a remote location. More specifically, the invention relates to an apparatus for transferring cryogenic fluids to or from a floating vessel and providing for more rapid chilling or pre-cooling of the apparatus to suitably low temperatures in preparation for such transfer operations.

BACKGROUND OF THE INVENTION

Natural gas is often discovered and produced in locations that are remote from where the gas can be marketed and distributed to end users. When suitable pipelines are available, the natural gas can be transported to market in either a gaseous or liquid form, however, there are many instances in which such pipelines are not available or practical for connecting a particular natural gas supply with consumers. When natural gas supplies are located overseas or a substantial distance from a suitable distribution system, it may be necessary to transport the gas by vessel. Such vessels typically include specially designed carriers that transport natural gas as a liquid housed in large insulated containers or tanks.

When transported at or near atmospheric pressure liquefied natural gas (LNG) is held at temperatures slightly below about −160° C. This temperature represents the boiling-point temperature for methane at atmospheric pressure. However, since the composition of natural gas will typically contain variable amounts of heavier and higher boiling hydrocarbons such as ethane, propane, butane and the like, the liquefied gas will be characterized by a somewhat higher boiling temperature, usually ranging from about −151° C. to about −164° C. depending upon composition. At or near a destination, the LNG must be regasified and warmed before it can be introduced into a distribution pipeline. In addition, depending on the requirements of the pipeline and local natural gas specifications, the LNG may be pressurized, depressurized, blended, odorized or subjected to other processing before it can be introduced into a pipeline or similar distribution system.

In both the loading and off-loading of LNG or other cryogenic fluids from a vessel, loading arm(s) and flow line(s) are used to transfer the cryogenic fluid. Due to the relatively low temperature of these fluids, the loading arms and flow lines must be pre-cooled or chilled to cryogenic temperatures before transfer operations can begin. Conventional cool-down procedures can require two to five hours depending on the materials and features of the arm and flow lines, the port requirements, and the manufacturer's recommendations. Modification of an apparatus for transferring cryogenic fluids that would enable such cool-down procedures to be completed more quickly while complying with port requirements and manufacturer recommendations would be advantageous and would enable additional vessels to be loaded and unloaded at a given terminal each year.

SUMMARY OF THE INVENTION

One embodiment of the present invention provides an apparatus for transferring cryogenic fluids. The apparatus includes a conduit having an inlet and an outlet; a source of cryogenic fluid connected to the inlet for providing cryogenic fluid to the conduit; and a cool down line connected to the conduit at an intermediate port between the inlet and the outlet, wherein the cool down line is in fluid communication with the source of cryogenic fluid for providing cryogenic fluid to the conduit through the intermediate port.

The conduit can comprise two or more sections and one or more of the conduit sections can be vertically oriented. The conduit can further comprise a joint interconnecting two of the sections. The joint can comprise a swivel joint so as to enable the two sections connected to the joint to articulate about the joint. When articulated to form an angle between two sections, an apex is formed in the conduit at the joint. The conduit has a first diameter and the cool down line has a second diameter, and the first diameter and the second diameter can have a ratio of at least 2:1. The source of cryogenic fluid can include a storage tank containing cryogenic fluid disposed on a floating vessel or on shore as well as a liquefaction unit disposed on a floating vessel or on shore. A manifold can be connected to the source of cryogenic fluid for controlling the flow of cryogenic fluid to the inlet and to the intermediate port.

The conduit can also have a second intermediate port between the inlet and outlet. The second intermediate port can be in fluid communication with the cool down line. In an alternative embodiment, the apparatus can include a second cool down line connected to the second intermediate port for providing cryogenic fluid to the second intermediate port. In such an embodiment, a manifold can be connected to the source of cryogenic fluid for controlling the flow of cryogenic fluid to the inlet, the first intermediate port and the second intermediate port. The appartus can also include a storage tank connected to the outlet for receiving cryogenic fluid from the conduit. Structural support for the conduit can be provided by a pedestal affixed to a jetty, dockside or a floating vessel.

In another embodiment, the present invention provides an apparatus for transferring cryogenic fluids. The apparatus includes a conduit having an inlet and an outlet; a source of cryogenic fluid connected to the inlet for providing cryogenic fluid to the conduit; and a cool down line disposed within the conduit, wherein the cool down line is in fluid communication with the source of cryogenic fluid and has an opening for providing cryogenic fluid to the conduit at an intermediate port between the inlet and outlet.

The conduit can comprise two or more sections and one or more of the conduit sections can be vertically oriented. The conduit can further comprise a joint interconnecting two of the sections. The joint can comprise a swivel joint so as to enable the two sections connected to the joint to articulate about the joint. When the joint comprises a swivel joint, the cool down line can be disposed within a single section. When articulated to form an angle between two sections, an apex is formed in the conduit at the joint. The conduit has a first diameter and the cool down line has a second diameter, and the first diameter and the second diameter can have a ratio of at least 2:1. The source of cryogenic fluid can include a storage tank disposed on a floating vessel or on shore as well as a liquefaction unit disposed on a floating vessel or on shore. A manifold can be connected to the source of cryogenic fluid for controlling the flow of cryogenic fluid to the inlet and to the intermediate port. The apparatus can also include a storage tank connected to the outlet for receiving cryogenic fluid from the conduit. Structural support for the conduit can be provided by a pedestal affixed to a jetty, dockside or a floating vessel.

BRIEF DESCRIPTION OF THE DRAWINGS

The invention may be understood by reference to the following description taken in conjunction with the accompanying drawings.

Figure 1:
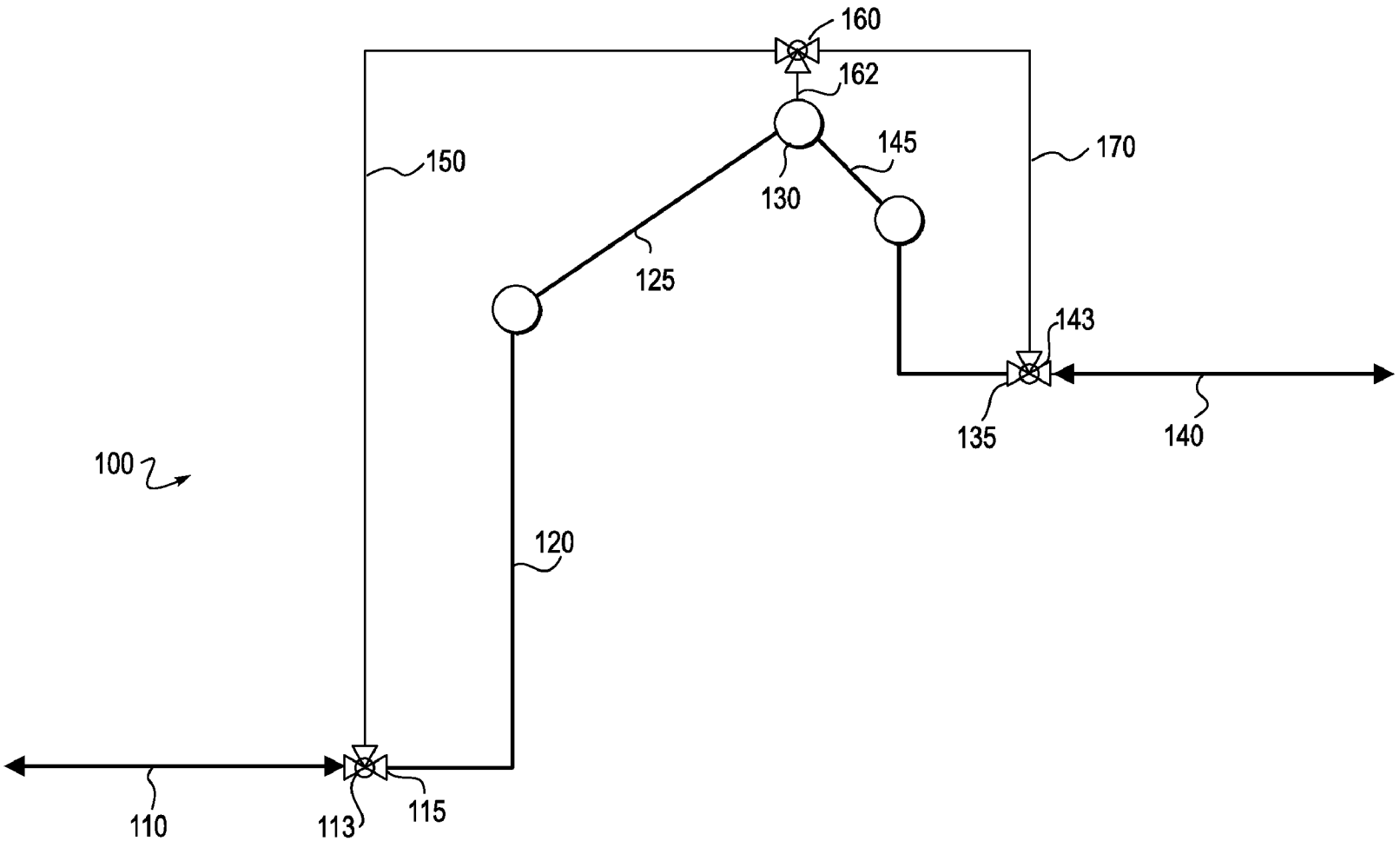
FIG. 1 is a schematic representation of an embodiment of the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE PREFERRED EMBODIMENTS

Illustrative embodiments of the invention are described below. In the interest of clarity, not all features of an actual embodiment are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover it will be appreciated that such a development effort might be complex and time-consuming, but would nevertheless be a routine undertaking for those of ordinary skill in the art having the benefit of this disclosure.

Although an apparatus of the present invention is frequently descried in terms of the transfer of liquefied natural gas, the apparatus is intended to be used for the transfer and transport of other cryogenic fluids as well. As used herein, and unless expressly stated otherwise, "cryogenic fluid" is intended to include any cryogenic fluid that is chilled with or without compression to reduce its volume for storage or transport. Examples of cryogenic fluids include liquefied natural gas, liquefied petroleum gas, compressed natural gas, and the like. More specifically, the cryogenic fluids that can be transferred utilizing an apparatus of the present invention can comprise methane, ethane, propane, butane, ammonia or mixtures of the same.

The pressure of the cryogenic fluid can range from ambient to an elevated pressure. Maintaining the cryogenic fluid at elevated pressure may be desirable for certain applications and fluids, particularly since fuilds at elevated pressures can frequently be held in a liquid phase at relatively higher temperatures. By way of example, some operators choose to maintain liquefied natural gas at elevated pressures in order to reduce the refrigeration load that is required to liquefy and hold the gas in the liquid state. As a result, the cryogenic fluids that can be transferred with an apparatus of the present invention can be at an elevated pressure, and in particular, at a pressure in the range between about 15 psig and about 650 psig.

The cryogenic fluids to be transferred with an apparatus of the invention have generally been chilled to a low temperature in order to reduce their volume. In some embodiments, the cryogenic fluid is at a temperature of less than about −50° C. In other embodiments, the cryogenic fluid is at a temperature of less than about −100° C. In still other embodiments, the cryogenic fluid is at a temperature of less than about −150° C. The temperature of the cryogenic fluid will depend on the composition of the fluid and the desired state or phase of the fluid during storage and transport. By way of example, natural gas can be cooled with or without compression to form LNG. When the LNG is to be stored and transported at or near atmospheric pressure, the gas must be chilled to less than about −160° C. to condense the gas to liquid. The natural gas is liquefied in a plant that is typically located on-shore near the site where the natural gas is produced, but may also be located in another location or off-shore depending on the location of the producing gas field.

Following liquefaction, cryogenic fluids are frequently held in cryogenic storage to await loading onto a vessel for transport to a remote market. Cryogenic storage is typically adjacent a liquefaction and/or a loading terminal so as to reduce the amount of boil off gas that might otherwise develop when the fluid is pumped or transferred. After transported by vessel to its destination, the cryogenic fluid is typically off-loaded and directed to storage. Where the cryogenic fluid is LNG, the LNG is held in storage until it is regasified for introduction into a gas distribution system. Whether cryogenic storage is to be used prior to or following transport, it is desirably located adjacent a waterway to enable direct access by floating vessels. In some cases flow lines may be provided to connect on-shore storage tanks with either a near-shore or off-shore terminal or buoy. Jetties are also commonly used for near-shore terminals where shore-side berthing at the storage site is unavailable.

Regardless of the precise location of the cryogenic storage relative to a liquefaction plant, a regasification plant or terminals, loading arms and flow lines will be required for loading and off-loading the cryogenic fluid from the floating vessel. The low temperatures of these fluids require that the loading arms and flow lines be pre-cooled to cryogenic or near-cryogenic temperatures prior to transfer operations. Failure to pre-cool these conduits produces thermal stresses that can result in failure or shortened life of the equipment. Moreover, a significant amount of cryogenic fluid may vaporize and form boil off gas as the fluid takes up heat from the relatively warmer conduit. While otherwise desirable, pre-cooling of the conduit prior to each transfer operation can require several hours depending on the length and configuration of the conduit, the local port requirements and recommendations of the manufacturer. The present invention is directed at reducing the time required to pre-cool a transfer or flow line, referred to generally herein as a "conduit", to a cryogenic temperature or other temperature suitable for transferring the cryogenic fluid.

More specifically, the present invention provides an apparatus for transferring a cryogenic fluid to or from a floating vessel. The apparatus comprises a conduit having an inlet and an outlet; a source of cryogenic fluid connected to the inlet for providing cryogenic fluid to the conduit; and a cool down line connected to the conduit at an intermediate port between the inlet and the outlet, wherein the cool down line in fluid communication with the source of cryogenic fluid for providing cryogenic fluid to the conduit through the intermediate port.

The cool down line enables the cryogenic fluid to be pumped into an inlet and one or more intermediate ports such that multiple sections of the conduit can be cooled simultaneously. In another embodiment, the apparatus comprises a conduit having an inlet and an outlet; a source of cryogenic fluid connected to the inlet for providing cryogenic fluid to the conduit; and a cool down line disposed within the conduit, wherein the cool down line is in fluid communication with the source of cryogenic fluid and having an opening for providing cryogenic fluid to the conduit at an intermediate port between the inlet and outlet.

The conduit can include any pipe, butting, flow line or transfer line that is suitable for use in transferring a cryogenic fluid. The conduit has an inlet, an outlet and at least one intermediate ports located between the inlet and outlet.

The conduit can be associated with or a component of a loading arm. Loading arms typically include a pedestal that is affixed to a jetty, dockside, or the deck of a floating vessel, and provides structural support to a conduit system and a counterbalance structure. Conventional LNG loading arms are commercially available from such companies as FMC Technologies, SVT Schwelm GmbH, Niigata Marine Loading Arms, Aker Kvaener Lading Arm Technologies and EMCO WHEATON GmbH. However, depending on the location and the configuration of the terminal, other conduits may be used to transfer the cryogenic fluid to a loading arm, storage tanks or directly to a floating vessel. Moreover, in certain ship to ship transfers, the conduit may not be associated with a convention loading arm.

The conduit can include a plurality of two or more conduit sections. One or more of the conduit sections can be vertical or vertically oriented, particularly when the conduit is associated with a loading arm. When the conduit includes two or more sections, a joint can be used to interconnect conduit sections. When the sections of the conduit are a part of a loading arm that extends out to connect with a ship's manifold, the joints connecting the conduit sections are typically swivel joints that enable the sections to articulate about the joint. When such arm is extended, an apex is typically formed in the conduit about at least one of the joints.

The conduit, conduit sections and joints are constructed of materials so that the conduit is suitable for handling the temperature and pressure conditions of the cryogenic fluid to be transferred. The size of the conduit sections can vary depending on the needs of the terminal, its location and the capacity of the vessels in service. Standard diameters range from 4 inches through 24 inches, with more typical diameters ranging between 16 inches and 20 inches. Examples of appropriate materials include high grade stainless steel and composites such as Invar that experience limited expansion and contraction in response to changes in temperature. The conduit may also include hoses and tubing specially designed for transferring LNG such as are described in greater detail in U.S. Pat. No. 4,315,408, issued Feb. 16, 408 to Karl, U.S. Pat. No. 4,445,543 issued May 1, 1984 to Mead, U.S. Pat. No. 6,012,292 issued Jan. 11, 2000 to Gulati, et al., and U.S. Pat No. 6,244,053 issued Jun. 12, 2001 to Gulati, et al.

The apparatus includes a source of cryogenic fluid connected to the inlet of the conduit for providing cryogenic fluid to conduit. Pumps, compressors, associated pipe or tubing, valves and manifolds can be included to connect the conduit to the source of the cryogenic fluid. The design and selection of such equipment should provide for variable flow rates and precise control over the flows. The source of cryogenic fluid can be a storage tank containing a cryogenic fluid or liquefaction unit located on shore, or a storage tank or liquefaction unit located onboard a floating vessel. A manifold can interconnect the source of cryogenic fluid, the inlet and the cool down line for controlling the flow of cryogenic fluid to the inlet and the one or more intermediate ports described below.

the apparatus further includes a cool down line connected to the conduit at an intermediate port between the inlet and the outlet. The purpose of the cool down line is to enable cryogenic fluid to be pumped into sections or portions of the conduit that are downstream from the conduit inlet. As a result, the cool down line is also in fluid communication with the source of cryogenic fluid. The cryogenic fluid that is pumped through the cool down line can be derived from a storage tank containing a cryogenic fluid or liquefaction unit located on-board a floating vessel and/or from a storage tank or liquefaction unit located on shore. In one embodiment, the cool down line and the inlet of the conduit are connected to or are in fluid communication with a common source of cryogenic fluid.

The cool down line is generally of smaller diameter than the conduit. In one embodiment, the cool down line is less than about 6 inches, in other embodiments less than about 4 inches, and in still other embodiments less than about 2 inches. Moreover, the conduit has a first diameter and the cool down line has a second diameter; the first diameter and the second diameter having a ratio of at least 2:1. In some embodiments, the cool down line is external to the conduit and intersects with the conduit at the intermediate port between the inlet and outlet of the conduit. In other embodiments, the cool down line is disposed within the conduit, concentrically or otherwise, and is in fluid communication with the conduit through one or more openings in the cool down line.

The intermediate port on the conduit can be located at any point intermediate the inlet and outlet. In one embodiment, the intermediate port is located at or in a joint where articulating sections of a conduit are joined. In other embodiments, the intermediate port is located adjacent to such a joint, and in still other embodiments, the intermediate port is located at an apex in the conduit.

Depending on the length of the conduit and the configuration of its sections, a second intermediate port can be located between the inlet and outlet of the conduit. The cryogenic fluid that is pumped to this second intermediate port may be directed through a common cool down line that is in fluid communication with another intermediate port, or through a second cool down line that is dedicated for providing fluid communication between the source of cryogenic fluid and the second intermediate port. Depending on the length and configuration of the conduit, it is envisioned that cryogenic fluid may be pumped into the conduit at a plurality of three or more intermediate ports between the inlet and outlet of the conduit.

The apparatus can also include a cryogenic storage tank located on shore or on a second floating vessel for receiving the cryogenic fluid from the outlet of the conduit.

In operation, a floating vessel having LNG storage tanks, sometimes described herein as an LNG carrier or ship, is first moored at an LNG terminal. Where the floating vessel is to engage in a ship to ship transfer, the floating vessel will be moored to or adjacent a second floating vessel. There are generally two or more and typically four loading arms that are used for transferring LNG to or from the vessel. One of these loading arms is generally dedicated for transferring vapor in the form of boil off gas that can form in a conduit or within a vessel's storage tanks. The vapor can be led ashore or to another vessel having facilities to receive and handle the vapor. This vapor return path also allows operators to control pressure within the shipboard tanks. In an alternative embodiment, the boil off gas might be re-condensed in a liquefaction unit onboard the vessel and directed to the vessel's storage tanks. In still other embodiments, the boil off gas might be directed to an on-board power generation unit or another onbaord facility. In such alternate embodiments, a vapor return arm and associated conduit to a shore side facility could be eliminated or used to transferring LNG.

Once the vapor return arm is connected to the manifold, Custody Transfer level readings are taken. The valve in the vapor return arm is then opened to allow boil off gas onboard the ship to be led ashore. After the other loading arm conduits are connected with the ship's manifold, operators can begin to prepare the conduits for transferring cryogenic fluid from the cryogenic storage tanks onboard the vessel.

After connecting the inlet of a conduit with the ship's manifold but before pre-cooling the conduit, operators will typically test the conduit for leaks and oxygen levels, and ensure that emergency systems are functioning properly. Depending on the oxygen level detected, the conduit may be purged before pre-cooling is initiated. Prior to LNG transfer, oxygen content within the conduit should be less than about 1% vol. When purging is desired, an inert gas such as nitrogen, argon, helium or the like, can be pumped through the conduit.

Pre-cooling of the conduit begins by pumping a reduced flow of the cryogenic fluid into the inlet of the conduit. When the cryogenic fluid is LNG, the LNG is pumped into the conduit at a temperature of less than about −160° C. As the reduced floor of LNG slowly fills the conduit from the inlet, the section of the conduit in contact with the LNG is cooled to a temperature suitable for transferring LNG. The rate at which this reduced flow of LNG is pumped into the inlet of the conduit will be controlled so as to prevent thermal shock to the conduit and the storage tanks that will receive the transferred LNG. This cooling rate is generally prescribed by the recommendations of the loading arm and tank manufacturer but will also depend on the initial temperature and pressure conditions in the tanks as well. An acceptable chill rate for typical conduit and tank materials is less than 9° C. per hour.

The time required to adequately chill the conduit before cryogenic fluid can be transferred at a desired elevated rate will depend on the starting temperature of the conduit, its length and the configuration of its sections among other factors. In many conduits, particularly those associated with LNG loading arms, the conduit has a vertical section or riser near the inlet. Moreover, where the conduit includes articulating sections that are joined by swivel joint, an apex may exist between the sections. In a conventional transfer apparatus or process, such a vertical section would have to be completely filled with LNG before the fluid could spill over and begin to cool downstream sections of the conduit, necessarily delaying the transfer operation. A cool down line capable of delivering cryogenic fluid to the conduit at an intermediate port located between the inlet and outlet enables an apparatus of the present invention to pre-cool down downstream sections of the conduit simultaneous with those sections that are near the inlet.

When the conduit has cooled to a temperature suitable for transferring the cryogenic fluid, the flow of cryogenic fluid can be increased to a maximum transfer rate. This maximum transfer rate will depend on the capacity and conditions of the storage tanks receiving the cryogenic fluid, the vessel's manifold system and the size of the conduit. The cryogenic fluid can be pumped through a 16 inch conduit at a rate of 5000 $m^3$/hr, but again the capacity of a given vessel's manifold may further limit this flow rate.

DETAILED DESCRIPTION OF THE FIGURES

FIG. 1 is a schematic representation of apparatus 100 for use in transferring a cryogenic fluid to or from a floating vessel. Apparatus 100 includes flow line 110 which is in fluid communication with an on shore LNG storage tank system (not shown). Flow line 110 has manifold 113 that is connected to inlet 115 of conduit 120. Conduit 120 has inlet 115, sections 125 and 145, joint 130, intermediate port 162, and outlet 135. Although not illustrated in detail, intermediate port 162 is located within joint 130. Outlet 135 is connected with manifold 143 onboard a floating vessel (not shown). Apparatus 100 also cool down line 150 for directed cryogenic fluid from manifold 113 through valve 160 and into the conduit at intermediate port 162. Cool down line 170 is provided when the cryogenic fluid to be pumped into the conduit at the intermediate port is derived from a source of cryogenic fluid on board the floating vessel.

During a cool-down operation, a reduced flow of cryogenic fluid is pumped into inlet 115 and up through conduit section 125. A reduced flow of cryogenic fluid is also pumped through cool down line 150 and into conduit 120 at intermediate port 162. The cryogenic fluid entering the conduit at intermediate port 162 flows down through downstream section 145 toward outlet 135. The result is that vertically oriented section 125 and section 145 on either side of joint 130 are cooled simultaneously, thereby reducing the time required to cool the conduit as a whole.

Figure 2:
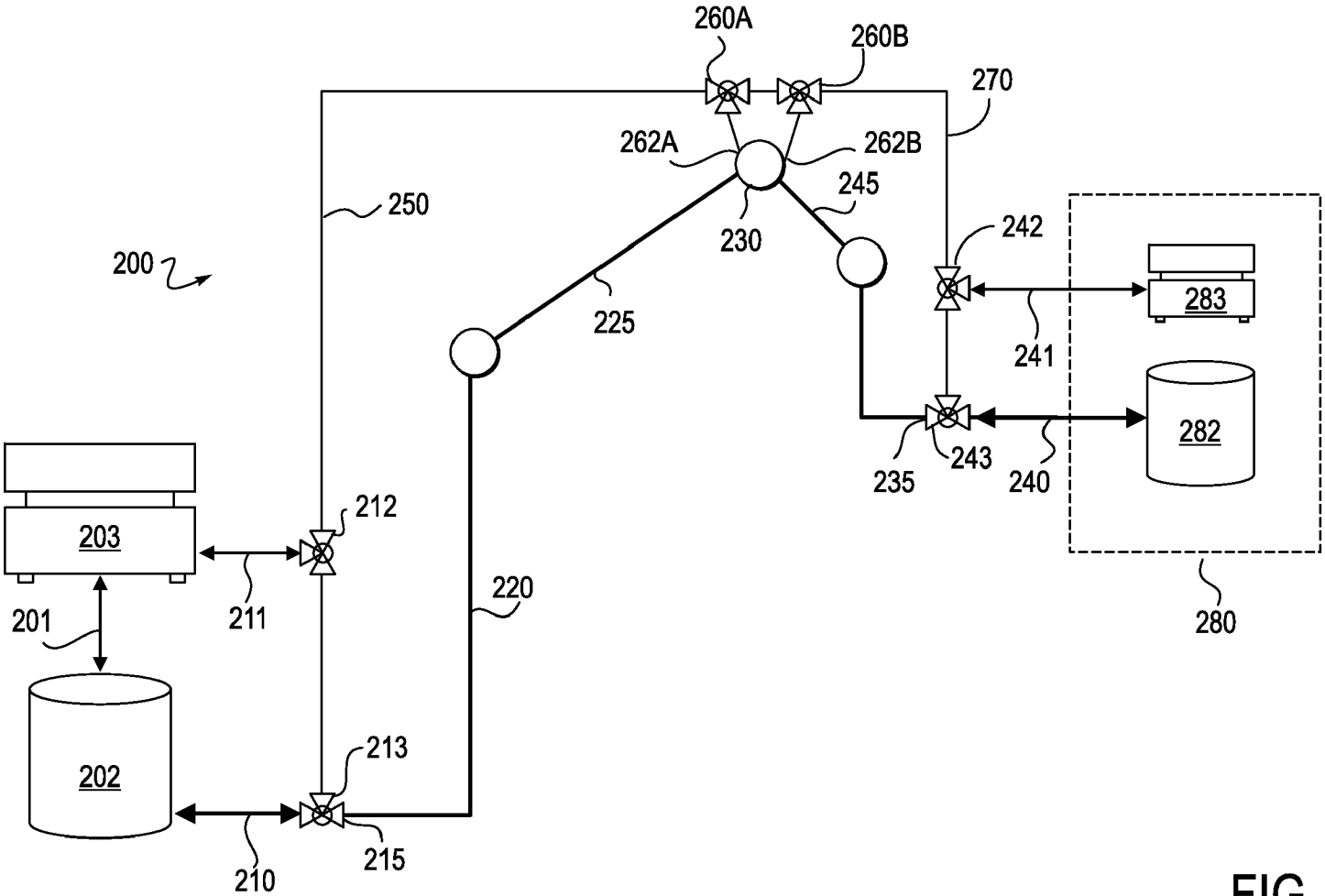
FIG. 2 is a schematic representation of an embodiment of the present invention.

FIG. 2 is an illustration of apparatus 200 for use in transferring a cryogenic fluid to or from a floating vessel (not shown). Apparatus 200 includes an onshore cryogenic storage tank 202 and liquefaction unit 203, and cryogenic storage tank 282 and liquefaction unit 283 disposed onboard floating vessel 280. Flow line 210 is for directing cryogenic fluid to or from cryogenic storage tank 202 to valve 213. Flow line 211 is for directing cryogenic fluid to or from liquefaction unit 203 to valve 212. Flow line 241 is for directing cryogenic fluid to or from liquefaction unit 283 to valve 242. Flow line 240 is for directing cryogenic fluid to or from tank 282 from conduit 220. As illustrated, conduit 220 has inlet 215, sections 225 and 245, joint 230, intermediate ports 262A and 262B and outlet 235. Intermediate ports 262A and 262B are adjacent joint 230 on opposite sides of the joint. Although the onboard manifold for vessel 280 is not illustrated in detail, valves 242 and 243 control the flow of cryogenic fluids between liquefaction unit 283, storage tank 282, conduit 220, and cool down line 270. Similarly, valves 212 and 213 control the flow of cryogenic fluids between liquefaction unit 203, storage tanks 202, conduit 220 and cool down line 250. Cool down lines 250 and 270 are connected through valves 260A and 260B, which control the flow of cryogenic fluid to conduit through intermediate ports 262 and 262B respectively.

During a cool-down operation, a reduced flow of cryogenic fluid is pumped into inlet 215 up through conduit section 225 and a reduced flow of cryogenic fluid is also pumped through cool down line 250 and into conduit 220 at intermediate port 262A. The cryogenic fluid entering the conduit at intermediate port 262A flows down through downstream section 225 toward inlet 215. In the alternative or in addition, a reduced flow of cryogenic fluid is also pumped through cool down line 250 and into conduit 220 at intermediate port 262B. The cryogenic fluid entering the conduit at intermediate port 262B flows down through section 245 toward outlet 235. The result is that section 225 and section 245 on opposite sides of joint 230 are cooled simultaneously, thereby reducing the time required to cool the conduit as a whole.

Cool down line 270 is connected with storage tank 282 and liquefaction unit 283 onboard floating vessel 280, which can serve as an alternative source of cryogenic fluid for use in cooling conduit 220. In some embodiments, a reduced flow of cryogenic fluid can be pumped into the conduit through outlet 235 and one or more of intermediate ports 262A and 262B during a cool down opertion. In other embodiments, a reduced flow of cryogenic fluid can be pumped into each of inlet 215, outlet 235 and intermediate ports 262A and 262B. Depending on the flows of cryogenic fluid to the intermediate ports 262A and 262B, liquefaction unit 203 or 283 can be used to re-condense boil off gas that is vaporized during the cool down procedure.

Figure 3:
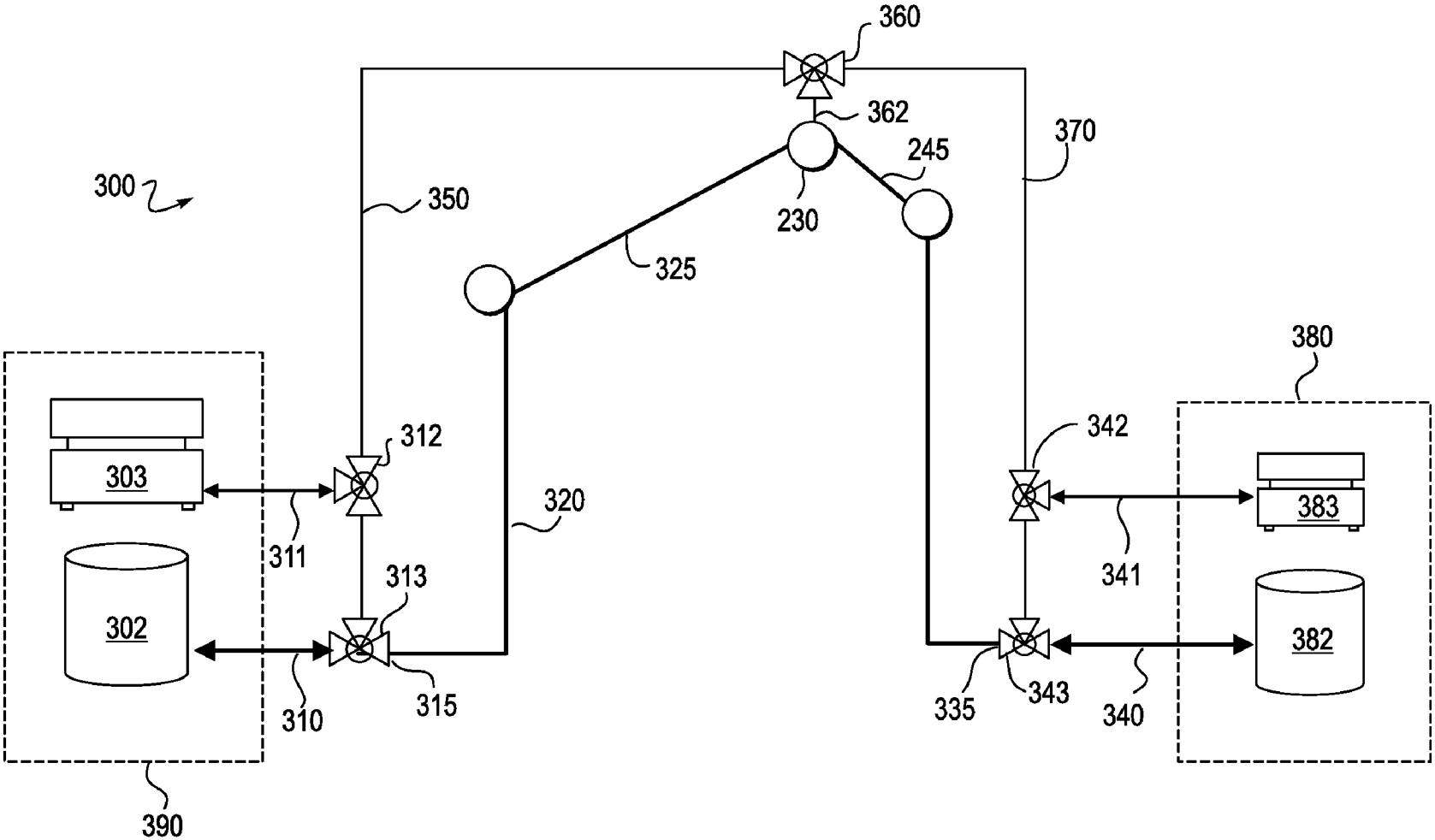
FIG. 3 is a schematic representation of an embodiment of the present invention.

FIG. 3 is an illustration of apparatus 300 for use in transferring a cryogenic fluid between floating vessels indicated by broken lines 380 and 390. Apparatus 300 includes cryogenic storage tank 302 and liquefaction unit 303 onboard floating vessel 390, and cryogenic storage tank 382 and liquefaction unit 383 disposed onboard floating vessel 380. Flow line 340 is for directing cryogenic fluid to or from the conduit from tank 382, while flow line 310 is for directing cryogenic fluid to or from the conduit from tank 302. Flow line 341 is for directing cryogenic fluid to or from cool down line 370 from liquefaction unit 383, while flow line 311 is for directing cryogenic fluid to or from cool down line 350 from liquefaction unit 303. As illustrated, conduit 320 has inlet 315, sections 325 and 345, joint 330, intermediate port 362, and outlet 335. Although the onboard manifold for vessel 380 is not illustrated in detail, valves 342 and 343 control the flow of cryogenic fluids between liquefaction unit 383, storage tank 382, conduit 320, and cool down line 370. Similarly, valves 312 and 313 control the flow of cryogenic fluids between liquefaction unit 303, storage tanks 302, conduit 320 and cool down line 350. Cool down lines 350 and 370 are connected through valve 360, which controls the flow of cryogenic fluid to conduit 320 through intermediate port 362.

During a cool-down operation, a reduced flow of cryogenic fluid is pumped into inlet 315 up through conduit section 325 and a reduced flow of cryogenic fluid is also pumped through cool down line 350 and into conduit 320 at intermediate port 262. The cryogenic fluid entering the conduit at intermediate port 362 flows down through section 345 toward outlet 335. The result is that section 325 and section 345 on opposite sides of joint 330 are cooled simultaneously, thereby reducing the time required to cool the conduit as a whole.

Cool down line 370 is connected with storage tank 382 and liquefaction unit 383 onboard floating vessel 380, which can serve as an alternative source of cryogenic fluid for use in cooling condit 320. In some embodiments, a reduced flow of cryogenic fluid can be pumped into the conduit through outlet 335 and through intermediate ports 362 during the cool down operation. In still other embodiments, a reduced flow of cryogenic fluid can be pumped into each of inlet 315, outlet 335, and intermediate port 362. Depending on the flow of cryogenic fluid to intermediate port 362, liquefaction unit 303 or 383 can be used to re-condense boil off gas that is vaporized during the cool down procedure.

Figure 4A:
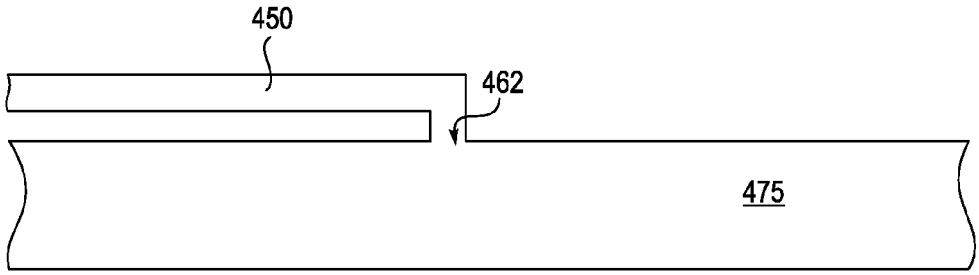
FIG. 4A is a side cross sectional view of a conduit and cool down line.

FIG. 4A is a side cross sectional view of a conduit section 475 and cool down line 450. Intermediate port 462 provides fluid communication between conduit section 445 and the cool down line.

Figure 4B:
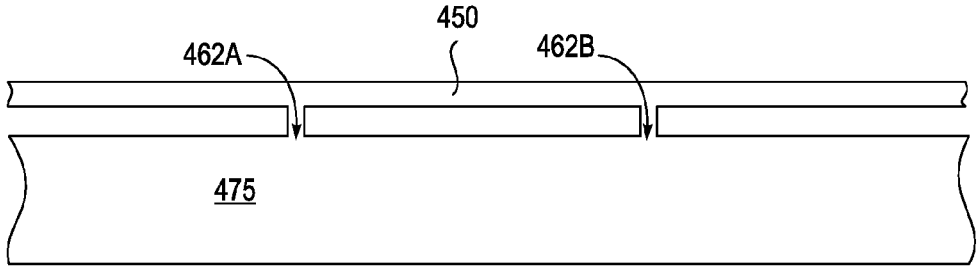
FIG. 4B is a side cross sectional view of a conduit and cool down line.

FIG. 4B is a side cross sectional view of conduit section 475 and cool down line 450. Intermediate ports 462A and 462B provide fluid communication between conduit section 445 and the cool down line.

Figure 4C:
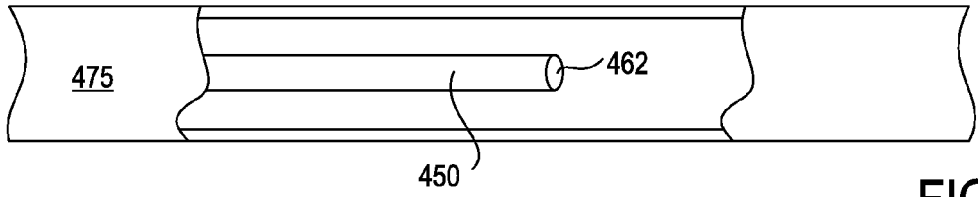
FIG. 4C is a cut away view of the conduit and cool down line.

FIG. 4C is a cut away view of conduit section 475 and cool down line 450 disposed within the conduit section. Intermediate port 462 provides fluid communication between conduit section 445 and the cool down line.

Figure 4D:
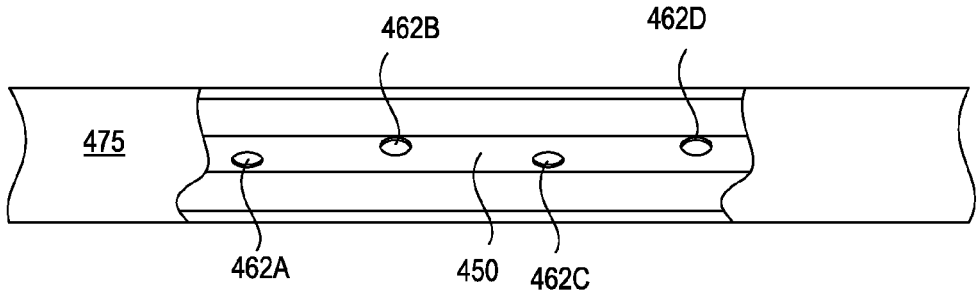
FIG. 4D is a cut away view of the conduit and cool down line.

FIG. 4D is a cut away view of conduit section 475 and cool down line 450 disposed within the conduit section. Intermediate ports 462A, 462B, 462C and 462D provide fluid communication between the cool down line and conduit section 445.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. An apparatus for transferring cryogenic fluid between a source and a destination, the apparatus comprising:

a conduit suitable for transporting a cryogenic fluid having an inlet adapted to receive a cryogenic fluid, an outlet for delivering cryogenic fluid from the conduit, and an intermediate port intermediate the inlet and the outlet forming a first section between the inlet and the intermediate port and a second section between the intermediate port and the outlet; and a cool down line adapted to receive a cryogenic fluid and deliver the cryogenic fluid to the intermediate port;

wherein the inlet may move relative to the outlet to accommodate movement there between; and wherein cryogenic fluid may be introduced into the inlet and the intermediate port so that the first and second sections of the conduit may be simultaneously cooled.

2. The apparatus of claim 1 wherein:

the apparatus has multiple ports between the inlet and the outlet forming multiple sections and multiple cooling lines adapted to receive cryogenic fluids and deliver the cryogenic fluids to the multiple ports so that the multiple sections can be simultaneously cooled.

* * * * *